US009157339B2

(12) United States Patent
Stretch et al.

(10) Patent No.: US 9,157,339 B2
(45) Date of Patent: Oct. 13, 2015

(54) HYBRID CAM-CAMLESS VARIABLE VALVE ACTUATION SYSTEM

(71) Applicant: Eaton Corporation, Cleveland, OH (US)

(72) Inventors: Dale Arden Stretch, Novi, MI (US); David Gerard Genise, Marshall, MI (US); Douglas John Nielsen, Marshall, MI (US); James Edward McCarthy, Jr., Marshall, MI (US)

(73) Assignee: Eaton Corporation, Cleveland, OH (US)

( * ) Notice: Subject to any disclaimer, the term of this patent is extended or adjusted under 35 U.S.C. 154(b) by 83 days.

(21) Appl. No.: 14/045,490

(22) Filed: Oct. 3, 2013

(65) Prior Publication Data

US 2014/0116363 A1 May 1, 2014

Related U.S. Application Data

(60) Provisional application No. 61/710,428, filed on Oct. 5, 2012, provisional application No. 61/715,256, filed on Oct. 17, 2012, provisional application No. 61/715,255, filed on Oct. 17, 2012.

(51) Int. Cl.
*F01L 1/34* (2006.01)
*F01L 1/24* (2006.01)
(Continued)

(52) U.S. Cl.
CPC . *F01L 1/24* (2013.01); *F01L 1/181* (2013.01); *F01L 9/02* (2013.01); *F01L 2001/0535* (2013.01); *F01L 2003/253* (2013.01); *F01L 2009/028* (2013.01)

(58) Field of Classification Search
CPC ..... F01L 1/24
USPC ..... 123/90.15, 90.16
See application file for complete search history.

(56) References Cited

U.S. PATENT DOCUMENTS 5,248,123 A 9/1993 Richeson et al.
5,456,222 A 10/1995 Schechter
(Continued)

FOREIGN PATENT DOCUMENTS

EP 1464794 10/2004
GB 2394000 4/2004
(Continued)

OTHER PUBLICATIONS

International Search Report and Written Opinion for International Application No. PCT/US2013-063376 dated Mar. 4, 2014.

*Primary Examiner* — Zelalem Eshete
(74) *Attorney, Agent, or Firm* — Remarck Law Group PLC

(57) ABSTRACT

An internal combustion engine has a cylinder head mounted to an engine block that at least partially forms a plurality of cylinder combustion chambers. The cylinder head has multiple intake ports and multiple exhaust ports. Engine valves regulate the passage of gas into and out of the combustion chamber. Cam-operated engine valves are mechanically coupled to a rotating cam directly or through one or more of a variety of components that assist in transforming the rotational kinetic energy of the cam to linear motion of the engine valves. One of the exhaust valves and one of the intake valves are mechanically coupled to the cam. Electrohydraulic actuators actuate separate intake and exhaust valves of a particular cylinder. The electrohydraulic actuators are in fluid communication with a high pressure fluid source.

19 Claims, 9 Drawing Sheets

(51) Int. Cl.

| | |
|---|---|
| ***F01L 9/02*** | (2006.01) |
| ***F01L 1/18*** | (2006.01) |
| *F01L 1/053* | (2006.01) |
| *F01L 3/00* | (2006.01) |

(56) References Cited

U.S. PATENT DOCUMENTS

| | | | | |
|---|---|---|---|---|
| 5,647,318 | A * | 7/1997 | Feucht et al. | 123/322 |
| 5,713,316 | A | 2/1998 | Sturman | |
| 2002/0162524 | A1 | 11/2002 | Ojeda | |
| 2003/0164163 | A1 | 9/2003 | Lei et al. | |
| 2004/0040530 | A1 | 3/2004 | Katsumata | |
| 2008/0091329 | A1 | 4/2008 | Duret | |
| 2010/0191442 | A1 | 7/2010 | Kirk | |

FOREIGN PATENT DOCUMENTS

| | | |
|---|---|---|
| JP | 2000282823 | 10/2000 |
| WO | 9639572 | 12/1996 |

* cited by examiner

HYBRID CAM-CAMLESS VARIABLE VALVE ACTUATION SYSTEM

CROSS-REFERENCE TO RELATED APPLICATIONS

This application claims the benefit of U.S. Provisional Application No. 61/710,428, which was filed on Oct. 5, 2012, and U.S. Provisional Application Nos. 61/715,255 and 61/715,256, which were filed on Oct. 17, 2012. The disclosures of each of the above applications are incorporated herein by reference in their entirety.

FIELD OF INVENTION

The present disclosure concerns valve actuation systems of internal combustion engines.

BACKGROUND

Valve actuation systems typically involve a rotating cam that actuates engine valves directly or through mechanical devices such as rocker arms, including deactivating rocker arms and variable lift rocker arms, pushrods, hydraulic lash adjusters and tappets. Such valve actuation systems are dependent on lift provided by cam lobes in order to actuate a valve from a seated position. Such dependence is exhibited in both exhaust and intake valves. However, opening and closing of both exhaust and intake valves independently of the position of the cam can be beneficial for certain types of engine operation.

SUMMARY

An internal combustion engine has a cylinder head mounted to an engine block that at least partially forms a plurality of cylinder combustion chambers. The cylinder head has multiple intake ports and multiple exhaust ports. Valves regulate the passage of gas into and out of the combustion chamber. Cam-operated valves are mechanically coupled to a rotating cam directly or through one or more of a variety of components that assist in transforming the rotational kinetic energy of the cam to linear motion of the valves. One of the exhaust valves and one of the intake valves are mechanically coupled to the cam. Electrohydraulic actuators actuate separate intake and exhaust valves of a particular cylinder. The electrohydraulic actuators are in fluid communication with a high pressure fluid source.

BRIEF DESCRIPTION OF THE DRAWINGS

In the accompanying drawings, structures and methods are illustrated that, together with the detailed description provided below, describe aspects of a hybrid cam-camless valve actuation system. It will be noted that a single component may be designed as multiple components or that multiple components may be designed as a single component.

Further, in the accompanying drawings and description that follow, like parts are indicated throughout the drawings and written description with the same reference numerals, respectively. The figures are not drawn to scale and the proportions of certain parts have been exaggerated for convenience of illustration.

DETAILED DESCRIPTION

Figure 1:
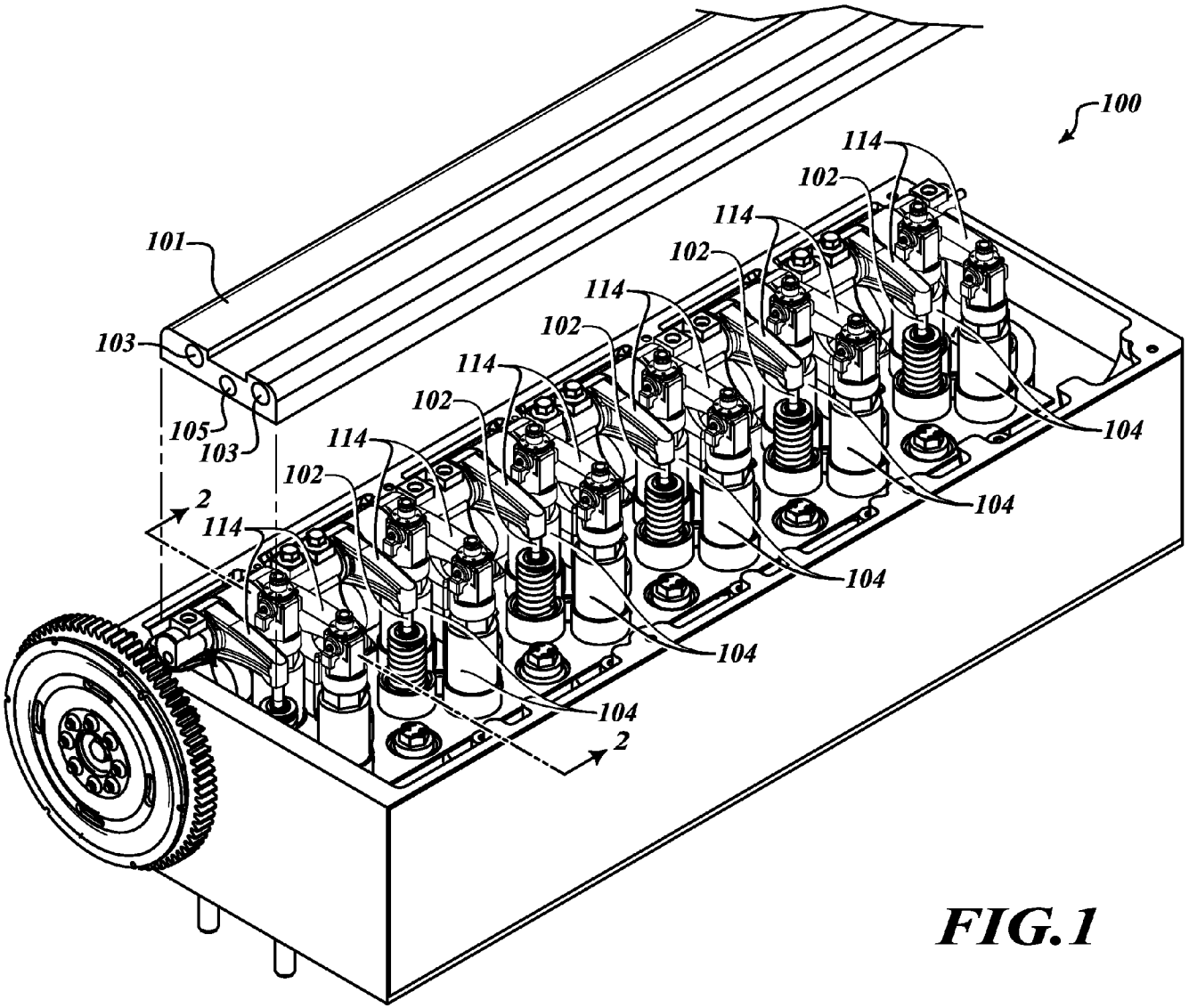
FIG. 1 illustrates a partially exploded perspective view of a valve head 100.

FIG. 1 illustrates a valve head 100 according to one aspect of the present teachings. The illustrated valve head 100 is configured to be mounted on an engine block of a diesel engine. However, the present teachings are not limited to diesel engines, and are applicable to other types of internal combustion engines such as those consuming gasoline, biofuels or other fuels. An engine block on which the valve head 100 can be mounted can contain piston bores. Pistons can be inserted into such bores to form combustion chambers. The valve head 100 can form the top portion of the combustion chambers when mounted on the engine block.

The illustrated valve head 100 is for use with six cylinders of a twelve cylinder engine. The twelve cylinder engine is a V-type engine having six cylinders on each side. However, the present teachings are applicable to other engine configurations as well, such as straight engine configurations, and different numbers of cylinders more or less than twelve. For example, the present teachings are applicable to engines having six, eight and ten cylinders.

The valve head 100 shown in FIG. 1 includes a hybrid valve actuation system wherein both mechanical and electrohydraulic actuation mechanisms are used to open and close the engine valves of a particular cylinder. When mounted on an engine block, the valve head 100 forms part of six combustion chambers. The head 100 includes twenty-four engine valves in total, four for each of the combustion chambers partially formed by the valve head. A feed rail 101 can be mounted at the top of valve head 100. The feed rail 101 has two high pressure conduits 103 that supply high pressure hydraulic fluid to the electrohydraulic actuators 104 discussed further herein, and a low pressure drain conduit 105 that allows hydraulic fluid to flow from the electrohydraulic actuators 104.

Figure 2:
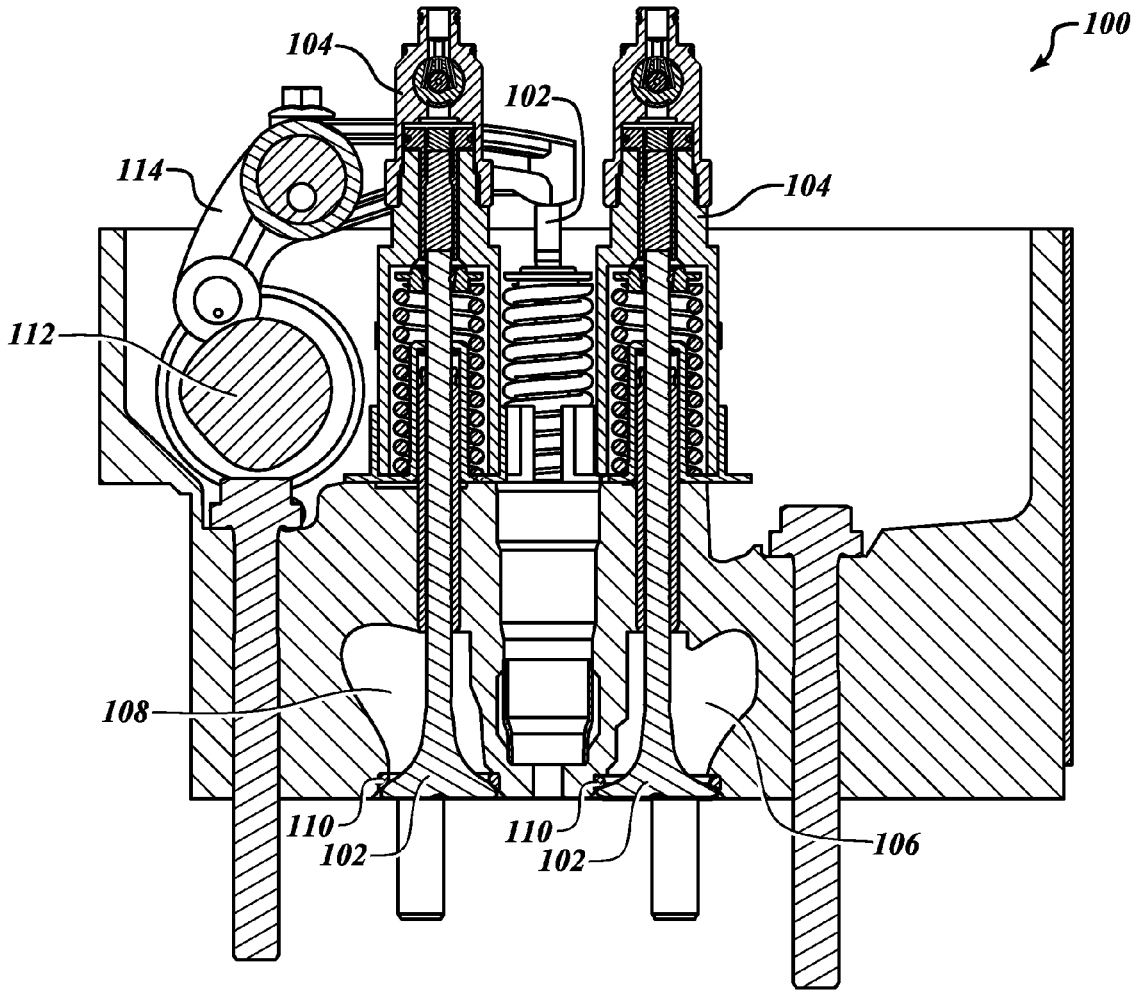
FIG. 2 illustrates a sectional view of the valve head 100 shown in FIG. 1 along the line 2-2.

FIG. 2 illustrates a sectional view of the valve head 100 shown in FIG. 1. As seen in FIG. 2, two of the engine valves 102 corresponding to one of the cylinders are actuated by an electrohydraulic actuator 104. The other two engine valves 102 of the cylinder are mechanically actuated by cam 112 and rocker arms 114. The valve head 100 includes intake 106 and exhaust ports 108 through which air enters and combusted gas leaves the combustion chamber, respectively, during engine operation. The engine valves 102 actuated by electrohydraulic actuators 104 open and close respective passages from the combustion chamber to intake and exhaust ports 106, 108. Thus, one of the intake ports 106 for a particular cylinder is regulated by one of the electrohydraulic actuators 104 and one of the exhaust ports 108 is also regulated by one of the electrohydraulic actuators 104. For a particular cylinder, the entry and exit of gas from the combustion chamber is regulated in part by the valves 102 that are actuated mechanically and in part by valves 102 actuated by electrohydraulic actuators 104. When closed, the engine valves 102 are seated against valve seats 110.

Mechanical actuation of engine valves 102 shown in FIGS. 1 and 2 is achieved through a rotating cam 112 periodically transferring motion to a rocker arm 114, which in turn transfers linear motion to engine valves 102. Such mechanical actuation illustrates one possible type of mechanical valve actuation according to the present disclosure. Other forms of mechanical actuation may also be implemented to transform the rotational motion of a cam to kinetic energy or mechanical potential energy, and ultimately to translational motion of engine valves 102. Such mechanisms include a rotating cam placed in direct contact with an engine valve 102, or by including one or both of a lash adjuster and rocker arm between a cam and engine valve. Still other combinations of various valve train components are possible in order to achieve mechanical actuation of an engine valve. Such components include but are not limited to rocker arms, including deactivating rocker arms and variable lift rocker arms, pushrods, hydraulic lash adjusters and tappets.

Figure 3:
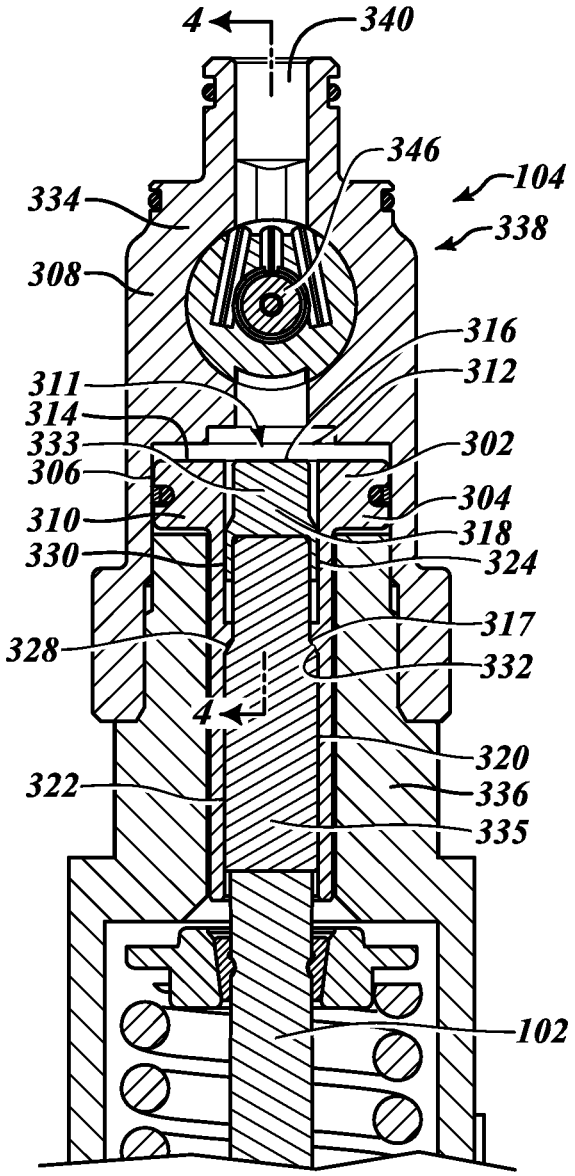
FIG. 3 illustrates a partial sectional view of an actuator 104 and engine valve 102 shown in FIG. 1.

FIG. 3 illustrates linear hydraulic actuator 104, which includes a two stage hydraulic piston 302. The two stage piston 302 has a large diameter piston member 304 partially disposed within a cavity 306 of an actuator housing 308. The large diameter piston member 304 has a cylindrically-shaped piston head 310 at one end 311 in fluid communication with hydraulic fluid that fills the volume 312. The volume 312 is formed in part by the housing 308, including the walls of the cavity 306, the upper surface 314 of the piston head 310 and the upper surface 316 of one end 311 of a small diameter piston 318. The piston head 310 has a cylindrical shape, and the cavity 306 has a size and shape that permits a close fit between the cavity 306 and piston 304, which in turn minimizes leaking of pressurized fluid from volume 312.

The small diameter piston member 318 is disposed within a tubular piston bore 320 in the large diameter piston member 304. Portions of the piston bore 320 have a shape complementary to the small diameter piston member 318. This complementary shape limits the motion of the small diameter piston member 318 with respect to the large diameter piston member 304. The small diameter piston member 318 has a cylindrically shaped outer surface 322 distal to the volume 312 relative to a frustoconical outer surface 328 of the small diameter piston member 318. The large diameter piston member 304 has a cylindrically shaped inner surface 323 that has a shape complimentary to the cylindrically shaped outer surface 322, and a frustoconical inner surface 332 that has a shape complimentary to the frustoconical outer surface 328. The complementary shapes limit the motion of the small diameter piston member 318 toward the volume 312.

The small diameter piston member 318 has another cylindrically shaped outer surface 324 proximal to the volume 312 relative to the frustoconical outer surface 328 of the small diameter piston member 318. The large diameter piston member 304 also has another cylindrically shaped inner surface 330 that has a shape complimentary to the cylindrically shaped outer surface 324 proximal to volume 312. The bore 320 is narrower at stop 317 than the diameter of the cylindrically shaped outer surface 324 of small diameter piston member 318. The stop 317 thus limits the downward motion of the small diameter piston member 304. The small diameter piston 318 includes a cap 333 and an insert 335. The insert 335 comes into contact with the engine valve 102, which contact causes the engine valve 102 to move in response to the motion of the piston 302. In other aspects of the present teachings, the insert 335 may be integrated into an engine valve 102.

According to one aspect of the present teachings, the actuator housing 308 of the hydraulic actuator 104 includes a valve housing 334 and a piston guide 336. In the illustrated actuator housing 308, the valve housing 334 is mounted above the piston guide 336. The piston 302 is partially inserted within the piston guide 336.

Figure 4:
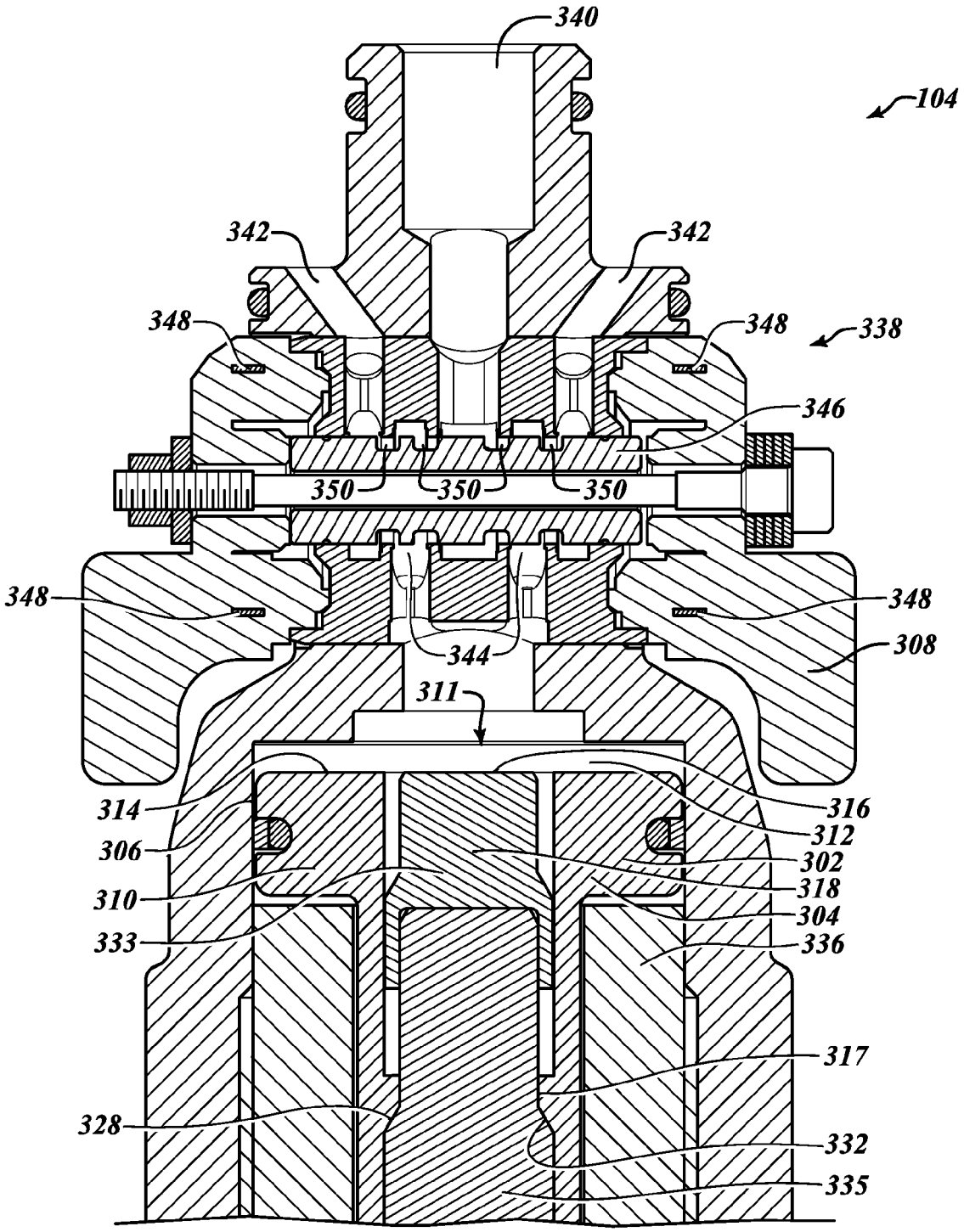
FIGS. 4 through 6 illustrate a partial sectional view of actuator 104 in various stages of actuation along the line 4-4 shown in FIG. 3.

As shown in FIG. 4, the hydraulic actuator 104 includes a two position solenoid-based pressure valve 338. The pressure valve 338 includes a high pressure inlet 340, and low pressure outlets 342. The pressure valve 338 also includes volume inlet ports 344 that permit fluid to enter the volume 312 from the high pressure inlet 340, or allow fluid to exit the volume 312 through the low pressure outlets 342. During operation, the high pressure inlet 340 is in fluid communication with the high pressure fluid source, such as a high pressure feed conduit 103 of the feed rail 101 described above, while the low pressure outlets 342 are in fluid communication with the low pressure reservoir, such as the low pressure drain conduit 105 of the feed rail 101. An actuator valve, such as the illustrated spool valve member 346, regulates the flow of hydraulic fluid between the high pressure inlet 340, low pressure outlet 342, and volume inlet port 344. The spool valve member 346 includes a magnetic material that is responsive to magnetic fields generated by the coils 348 of a solenoid that can be activated to shift the position of the spool valve member 346. The spool valve member 346 controls whether pressurized fluid flows into volume 312, which in turn controls actuation of the engine valve 102 coupled to the piston 302.

Figure 5:
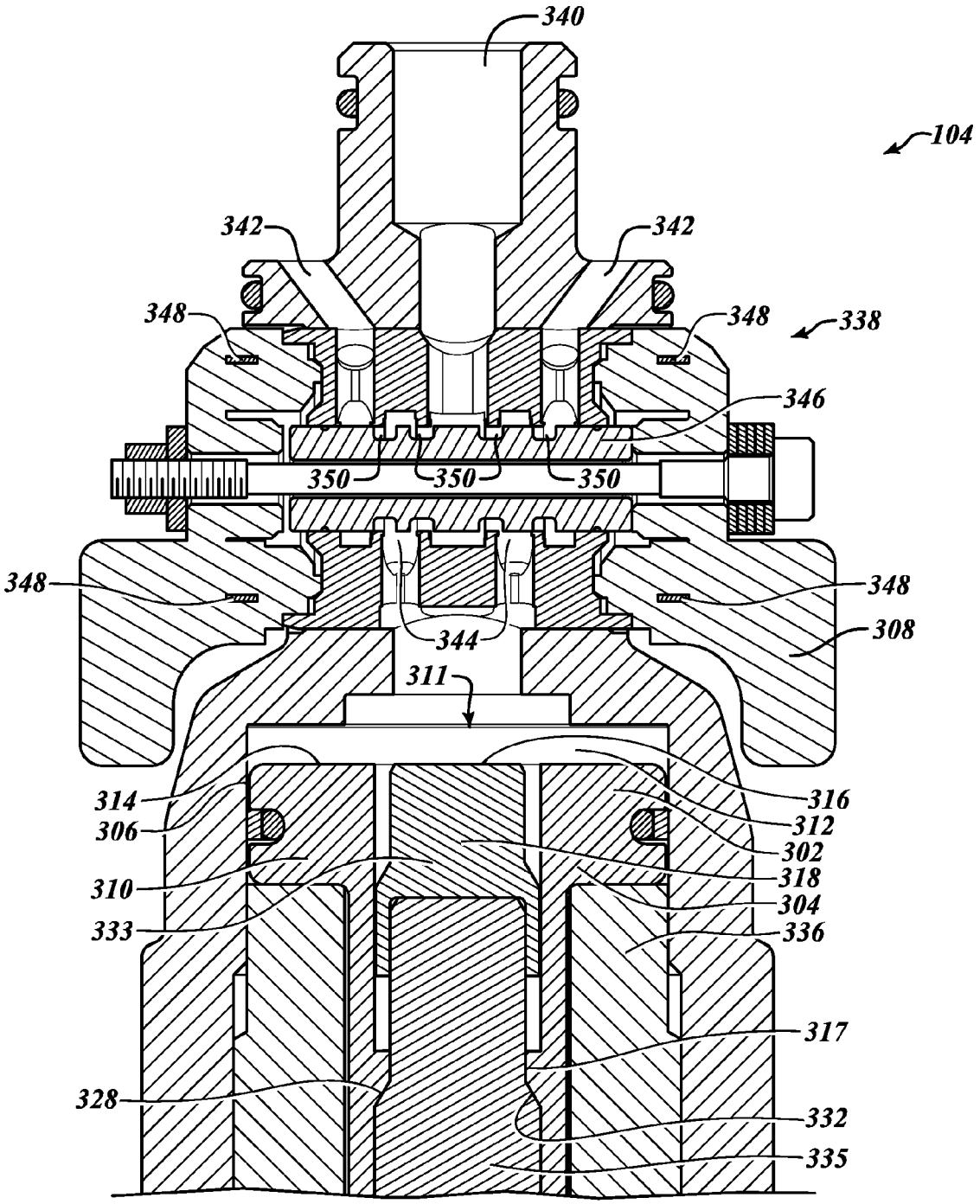
Figure 6:
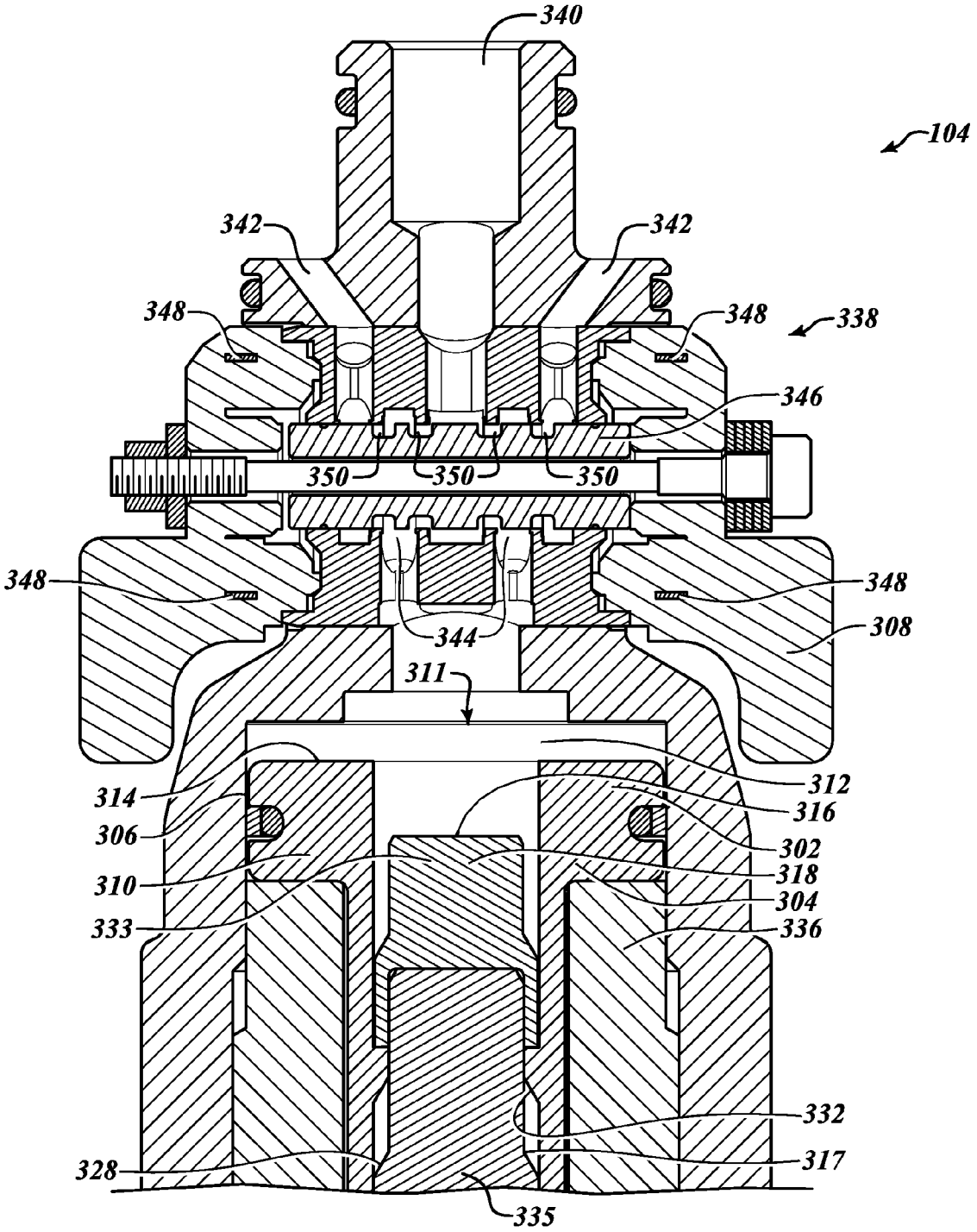

FIGS. 4 through 6 illustrate the electrohydraulic actuator 104 in various stages of actuation. During operation, the solenoid coils 348 can generate a magnetic field caused by electrical current in the coils 348. In FIG. 4, the coils 348 are not conducting current, and the spool valve member 346 is biased to the closed position to the left side of the actuator 104. In this position, high pressure fluid is not permitted into volume 312, while fluid in the volume 312 can exit via volume inlet port 344 and low pressure outlet 342.

The spool valve member 346 has a plurality of channels 350 that wrap around the spool valve member 346. Depending on the position of the spool valve member 346, the channels 350 allow passage of hydraulic fluid between a high pressure inlet 340, low pressure outlets 342, and volume inlet ports 344. When the illustrated spool valve member 346 is in a low pressure position as illustrated in FIG. 4, it is shifted to the left within actuator housing 308. In this position, the volume 312 is in fluid communication with the low pressure outlet 342, which in turn is configured to be in fluid communication with a low pressure reservoir. In this position, fluid within the volume 312 is free to flow through the volume inlet ports 344 and the low pressure outlet 342.

FIG. 5 illustrates the electrohydraulic actuator 104 in a state where the solenoid coils 348 have been activated, shifting the spool valve member 346 to the right. This allows high pressure hydraulic fluid to travel from the high pressure inlet 340, through channels 350 of the spool valve member 346 and the volume inlet port 344, to the volume 312.

After the spool valve member 346 shifts to the right, high pressure fluid fills the volume 312. When high pressure fluid begins to fill the volume 312, the small diameter piston member 318 and large diameter piston member 304 initially move in unison. The end surface 316 of the small diameter member 318 and end surface 314 of the large diameter member 304 form a large surface area acted upon by the pressurized fluid. In some aspects, the surface area of the end surface 314 of the large diameter member 304 is about nine times larger than the surface area of the end surface 316 of the small diameter member 318. In other aspects of the present disclosure, the ratio of the surface area of the end surface 314 versus the end surface 316 can be between about eight to ten. The large surface area results in a greater force applied by the high pressure hydraulic fluid than would be applied to a piston having a smaller surface area in pressure communication with volume 312. This increased force can assist in overcoming the opposing force applied to the engine valves 102 as a result of the pressure differential between the combustion chamber and the exhaust or intake ports, which force can be substantial even when the pressure differential is small. As shown in FIG. 5, the piston head 310 of the large diameter piston member 304 is in contact with the guide 336, and thus the downward motion of the large diameter piston member 304 has stopped. However, the small diameter piston member is not inhibited by the large diameter piston member's 304 contact with the guide 336.

As shown in FIG. 6, as high pressure hydraulic fluid continues to enter the volume 312, the small diameter piston member 318 moves independently of the large diameter piston member 304 and continues to move downwardly. The small diameter piston member 318 can continue downwardly until the cap 333 makes contact with the stop 317. In one aspect of the present teachings, the engine valve 102 reaches a fully opened position when the cap 333 contacts the stop 317 and the large diameter piston member 304 has made contact with the guide 336.

When the valve member 346 returns to the left side of the actuator 104, allowing fluid to flow from the volume 312 to the low pressure outlets 342, the small diameter piston member 318 moves upwardly until the frustoconical inner surface 332 meets the frustoconical outer surface 328. The large diameter piston member 304 and the small diameter piston member 318 then move in unison. When the large diameter piston member 304 and the small diameter piston member 318 both move, a greater volume of hydraulic fluid is displaced for every unit of length the engine valve 102 moves relative to the volume displaced when only the small diameter piston member 318 is moving. This results in a greatly reduced seating velocity of the engine valve 102 because there is a greater pressure drop with a greater amount of displaced fluid. The rate of fluid flow will also depend on the size of high pressure inlet 340, low pressure outlets 342 and volume inlet port 344.

Figure 7:
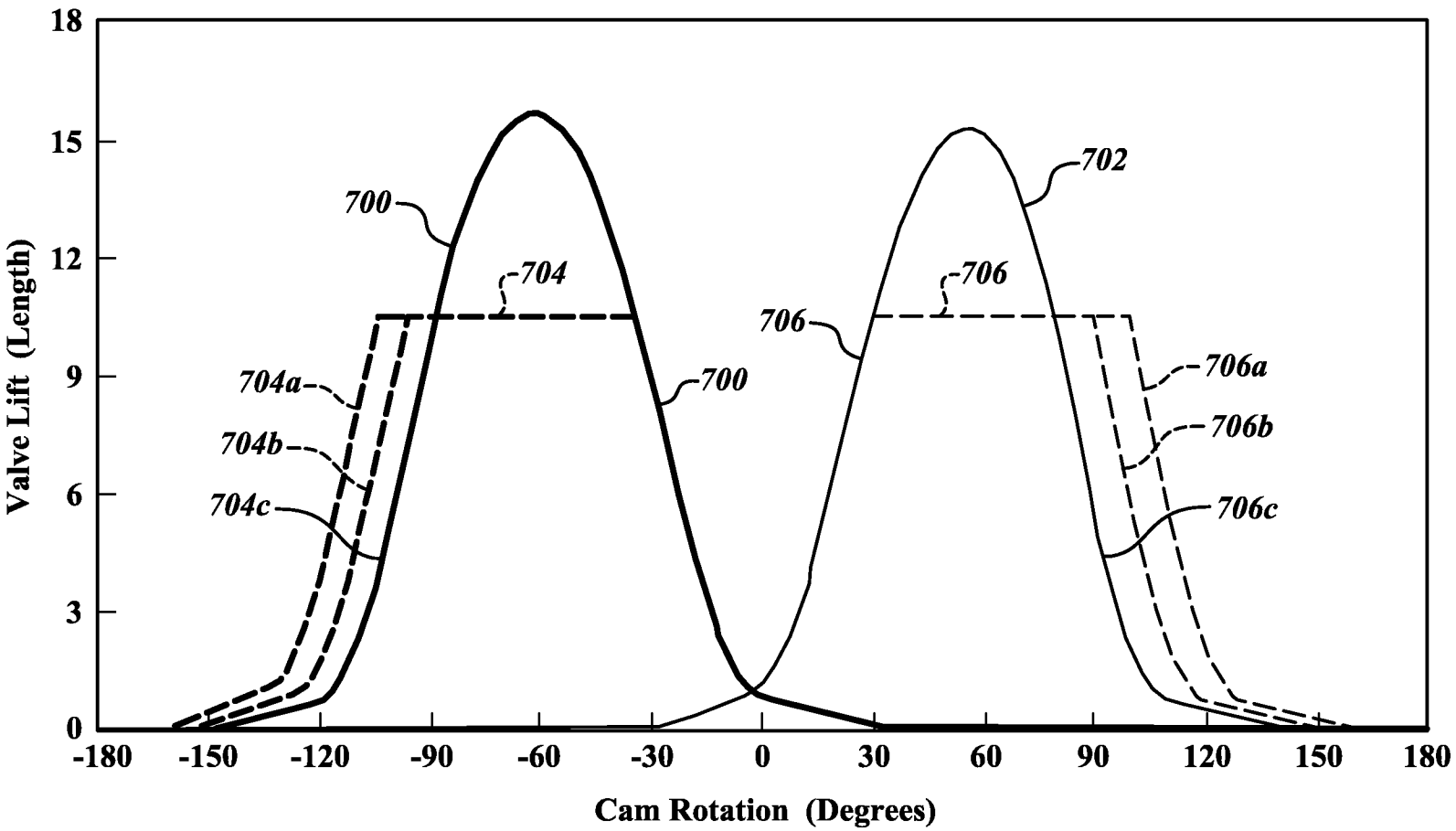
FIGS. 7 through 9 illustrate graphs of engine valve displacement over the angular position of the cam for a four-valve cylinder according to the present disclosure.

FIG. 7 illustrates engine valve lift for four engine valves of an engine cylinder measured in arbitrary standard units of length versus degrees of cam angular rotation. Line 700 corresponds to a cam-actuated exhaust valve and line 702 corresponds to a cam-actuated intake valve. Both of the engine valves represented by lines 700 and 702 are actuated at common points during the rotation of the cam. Lines 704*a*, 704*b* and 704*c* correspond to the various points of actuation of the electrohydraulically actuated exhaust valves according to the present teachings. Line 704*a* and 704*b* represent two possible valve opening profiles of electrohydraulically driven exhaust valves opening earlier than the cam-actuated exhaust valve 700. This type of early opening of the exhaust valves can be referred to as early exhaust valve opening or "EEVO." The electrohydraulically actuated exhaust valve can also follow the cam-actuated exhaust valve profile as shown by line 704*c*.

The electrohydraulically driven intake valve 706 may also be controlled independently of the cam-actuated intake valve 702. As shown by curves 706*a* and 706*b*, the intake valves may be kept open longer than the corresponding cam-actuated intake valve 702. Such intake valve actuation can be referred to as late intake valve closing or "LIVC." The electrohydraulically driven intake valve may also follow the cam-actuated intake valve profile as shown by line 706*c*.

Figure 8:
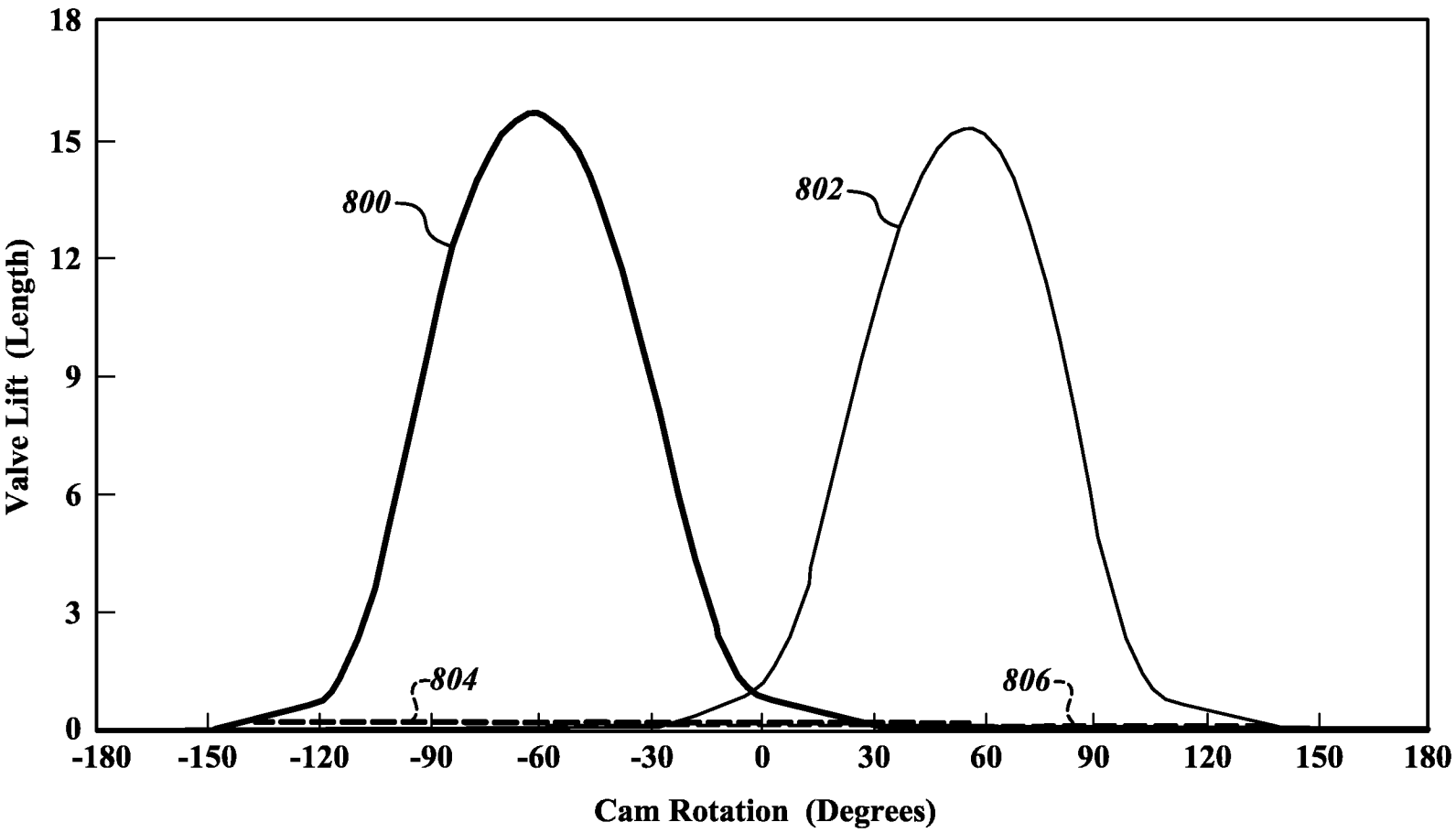

FIG. 8 illustrates engine valve lift for four valves of an engine cylinder exhibiting deactivation of the electrohydraulically actuated engine valves. The cam-actuated exhaust valve 800 and intake valve 802 operate normally, while the electrohydraulically actuated intake valves 804 and exhaust valves 806 are deactivated, and therefore stay closed. This engine valve management provides for greater velocity of the intake and exhaust gases. This can provide for improved swirl control, which can improve diffusion of fuel within the combustion chamber. In addition, deactivation of these valves reduces power consumed to generate the hydraulic pressure required to actuate the valves.

Figure 9:
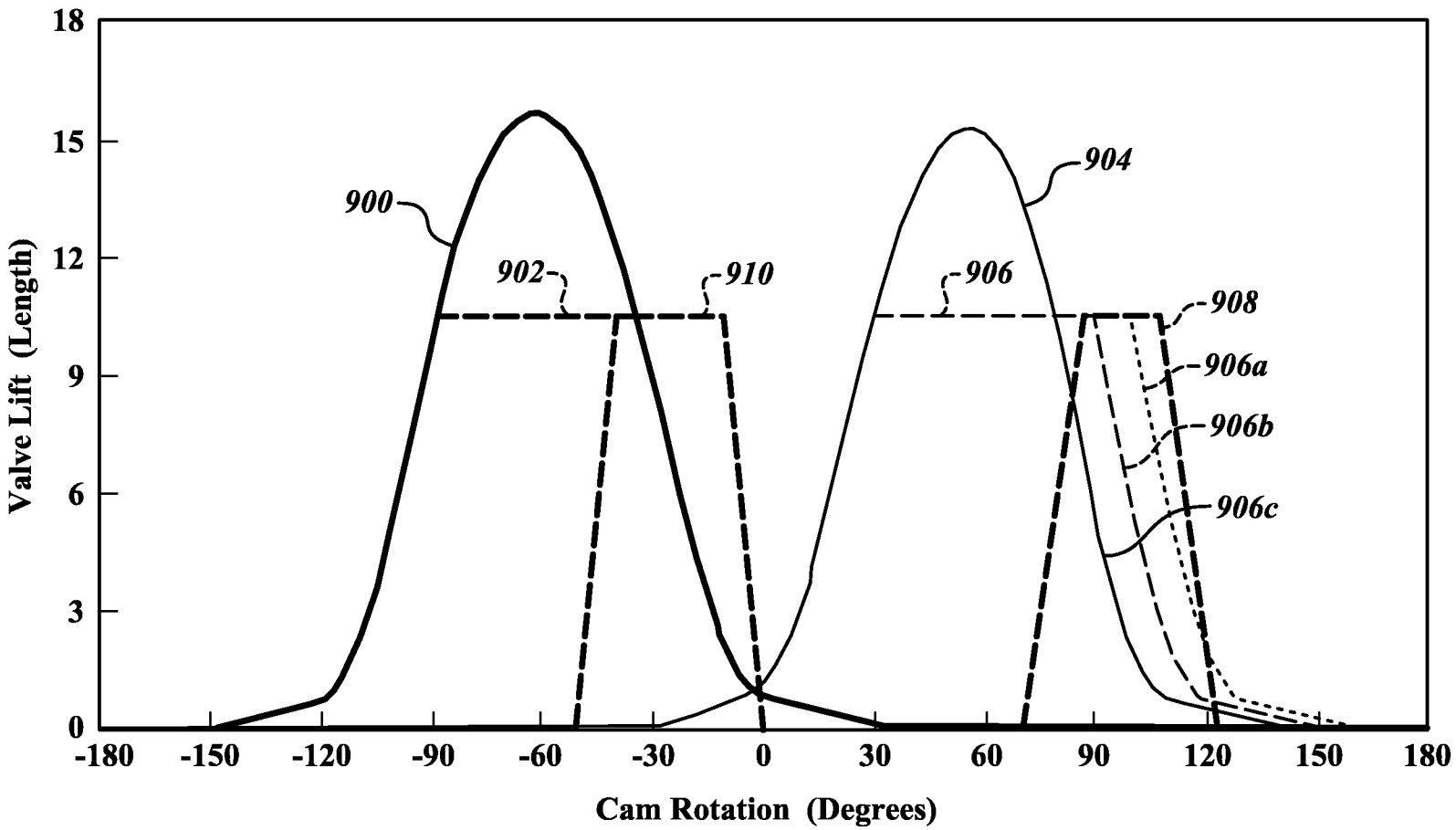

FIG. 9 illustrates another engine valve lift profile for four valves of an engine cylinder. The cam-actuated exhaust valve 900 and the electrohydraulically driven exhaust valve 902 open during common points in the cam cycle, for example between −120 degrees to 60 degrees. The cam-actuated intake valve 904 and the electrohydraulically driven intake valve 906 open during common points in the cam cycle. The electrohydraulically driven intake valve may close at various points after the cam-actuated intake valve is closed, or at the same time as the cam-actuated intake valve as shown by lines 906*a*, 906*b* and 906*c*. The electrohydraulically driven exhaust valve may be opened while the intake valves are open, as shown by line 908. This recirculates the exhaust gas into the combustion chamber. Such cylinder engine valve management can be referred to as exhaust gas recirculation, or "EGR." Engine braking may also be performed by the electrohydraulically actuated engine valves by opening the electrohydraulically actuated exhaust engine valve during a compression stroke as shown by line 910, thus removing energy from the cylinder.

The amount of displacement of the engine valves for can vary. Variable displacement of a particular valve 102 can be performed by a solenoid valve having two different actuation states, one effecting an engine valve displacement of a particular length and the second effecting an engine valve displacement of a different length. Such variation can also be achieved, for example, by including a second electrohydraulically actuated exhaust valve.

In some embodiments, the electrohydraulic actuator 104 can be utilized to provide variable displacement of a particular valve 102, such as between a closed position (FIG. 4), an intermediate lift position (FIG. 5), and a fully opened position (FIG. 6). For example only, the level of pressure of the high pressure fluid provided to the volume 312 can be varied to provide such variable valve lift. Varying the level of pressure of the high pressure fluid provided to the volume 312 can be performed, e.g., by the magnetic spool valve member 346, as well as by adjusting the pressure of the high pressure fluid provided to the high pressure inlet 340 directly.

When the level of pressure of the high pressure fluid is below a first threshold (such as by not providing high pressure fluid to the volume 312), the valve 102 can remain in the closed position shown in FIG. 4. For example only, the first threshold can correspond to a level of pressure of approximately 1,700 pounds per square inch. If the level of pressure of the high pressure fluid provided to the volume 312 is above the first threshold corresponding to the closed state, but below a second threshold, the valve 102 can be actuated to the intermediate lift position shown in FIG. 5. The intermediate lift position corresponds to a pressure sufficient to move the small diameter piston member 318 and large diameter piston member 304 in unison, but not separately. For example only, the second threshold can correspond to a level of pressure of approximately 2,000 pounds per square inch.

As described above, the end surface 316 of the small diameter member 318 and the end surface 314 of the large diameter member 304 form a large surface area acted upon by the high pressure fluid. This large, combined surface area results in a greater force applied by the high pressure fluid than would be applied to a piston having a smaller surface area in pressure communication with volume 312. Thus, the force applied to the large, combined surface area by the high pressure fluid may be sufficient to actuate the small diameter member 318 and the end surface 314 of the large diameter member 304 together, while remaining insufficient to provide the force necessary to actuate the small diameter member 318 by itself. The second threshold described above corresponds to the level of pressure at which the small diameter member 318 will move independently from the large diameter member 304.

In order to actuate the valve 102 to the fully opened position shown in FIG. 6, the level of pressure provided to the volume 312 can be above the second threshold. When the level of pressure of the high pressure fluid is above the second threshold, the force applied to the end surface 316 of the small diameter member 318 can be sufficient to move the small diameter member 318 independently from the large diameter member 304, as well as sufficient to move the small diameter piston member 318 and large diameter piston member 304 in unison.

By enabling an intermediate lift position, the electrohydraulic actuator 104 can provide an operating condition of the internal combustion engine in which one valve 102 (such as that mechanically actuated by a rotating cam) can be fully opened, while a second valve 102 (such as that actuated by the electrohydraulic actuator 104) can be actuated to the intermediate lift position. This may be particularly desirable for internal combustion engines that include two or more valves 102 for the intake ports 106 and/or the exhaust ports 108. The power consumption of the electrohydraulic actuator 104 can be proportional to the amount of valve lift. Thus, the power consumption of an internal combustion engine can be reduced by actuating a valve 102 that is actuated by the electrohydraulic actuator 104 to the intermediate lift position, while actuating the valve 102 that is mechanically actuated (e.g., by a rotating cam) to be fully opened, without noticeable loss of engine power and/or performance.

For the purposes of this disclosure and unless otherwise specified, "a" or "an" means "one or more." To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term. From about A to B is intended to mean from about A to about B, where A and B are the specified values.

While the present disclosure discusses various aspects in some detail, it is not the intention of the applicant to restrict or in any way limit the scope of the claimed invention to such detail. Additional advantages and modifications will be apparent to those skilled in the art. Therefore, the invention, in its broader aspects, is not limited to the specific details and illustrative examples shown and described. Accordingly, departures may be made from such details without departing from the spirit or scope of the applicant's claimed invention. Moreover, the foregoing teachings are illustrative, and no single feature or element is essential to all possible combinations that may be claimed in this or a later application.

What is claimed is:

1. An engine valve actuation system for an internal combustion engine that includes an engine block, a cylinder head mounted to the engine block to form at least one combustion chamber and defining a first port and a second port, a first valve arranged at least partially within the first port and movable between an opened position and a closed position to selectively open the first port, a second valve arranged at least partially within the second port and movable between an opened position and a closed position to selectively open the second port, and a rotating cam mechanically coupled to the first valve to selectively move the first valve between the open and closed positions, the engine valve actuation system comprising:

a hydraulic valve actuator coupled to the second valve to selectively move the second valve between the open and closed positions, the hydraulic valve actuator comprising:

an actuator housing having a piston cavity, an inlet port, a high pressure port in fluid communication with a high pressure fluid conduit, and a low pressure port in fluid communication with a low pressure fluid conduit, a piston disposed at least partially within the piston cavity and having a first surface at a first end in fluid communication with the inlet port, the first surface and actuator housing defining a volume, and an actuator valve disposed within the actuator housing in fluid communication with the inlet port, the high pressure port, the low pressure port and the volume through the inlet port.

2. The engine valve actuation system of claim 1, wherein:

the actuator housing includes a solenoid;

the actuator valve includes a magnetic spool valve member responsive to the solenoid such that the magnetic spool valve member is positioned in one of a first position and second position when the solenoid is activated the low pressure port is in fluid communication with a first spool channel of the spool valve member, the inlet port and the volume when the spool valve member is in the first position; and the high pressure port is in fluid communication with a second spool channel of the spool valve member, the inlet port and the volume when the spool valve member is in the second position.

3. The engine valve actuation system of claim 2, wherein the piston includes a first member and a second member, the second member being slideably disposed within the first member, the first surface of the piston formed at least in part by a first member surface and a second member surface.

4. The engine valve actuation system of claim 3, wherein the first member has a flanged head portion at a first end of the first member, and wherein the first member surface is larger than the second member surface.

5. The engine valve actuation system of claim 4, wherein the surface area of the first member surface is between about 8 to about 10 times the surface area of the second member surface.

6. The engine valve actuation system of claim 4, wherein the flanged head portion has a cylindrical outer surface and the first member has a cylindrical inner surface forming a passage extending from the first end of the first member to a second end of the first member, the second member being at least partially disposed within the passage.

7. The engine valve actuation system of claim 6, wherein:

the cylindrical inner surface has a first cylindrically shaped surface having a first diameter, a frustoconical portion extending between the first cylindrically shaped inner surface and a second cylindrically shaped inner surface having a second diameter larger than the first diameter, the first cylindrically shaped surface being closer to the first end than the second cylindrically shaped surface; and the second member has a first cylindrically shaped outer surface slideably engaged with the first cylindrically shaped inner surface, and a second cylindrically shaped outer surface slideably engaged with the second cylindrically shaped inner surface.

8. A hydraulic valve actuator configured to selectively actuate a valve of an internal combustion engine between an open and closed position, comprising:

an actuator housing having a piston cavity, an inlet port, a high pressure port in fluid communication with a high pressure fluid conduit, a low pressure port in fluid communication with a low pressure fluid conduit, and a solenoid;

a piston disposed at least partially within the piston cavity and having a first surface at a first end in fluid communication with the inlet port, the first surface and actuator housing defining a volume; and an actuator valve disposed within the actuator housing in fluid communication with the inlet port, the high pressure port, the low pressure port and the volume through the inlet port, the actuator valve including a magnetic spool valve member responsive to the solenoid such that the magnetic spool valve member is positioned in one of a first position and second position when the solenoid is activated, wherein the low pressure port is in fluid communication with a first spool channel of the magnetic spool valve member, the inlet port and the volume when the magnetic spool valve member is in the first position, and wherein the high pressure port is in fluid communication with a second spool channel of the magnetic spool valve member, the inlet port and the volume when the magnetic spool valve member is in the second position.

9. The hydraulic valve actuator of claim 8, wherein the piston includes a first member and a second member, the second member being slideably disposed within the first member, the first surface of the piston formed at least in part by a first member surface and a second member surface.

10. The hydraulic valve actuator of claim 9, wherein the first member has a flanged head portion at a first end of the first member, and wherein the first member surface is larger than the second member surface.

11. The hydraulic valve actuator of claim 4, wherein the flanged head portion has a cylindrical outer surface and the first member has a cylindrical inner surface forming a passage extending from the first end of the first member to a second end of the first member, the second member being at least partially disposed within the passage.

12. The hydraulic valve actuator of claim 11, wherein:

the cylindrical inner surface has a first cylindrically shaped surface having a first diameter, a frustoconical portion extending between the first cylindrically shaped inner surface and a second cylindrically shaped inner surface having a second diameter larger than the first diameter, the first cylindrically shaped surface being closer to the first end than the second cylindrically shaped surface; and the second member has a first cylindrically shaped outer surface slideably engaged with the first cylindrically shaped inner surface, and a second cylindrically shaped outer surface slideably engaged with the second cylindrically shaped inner surface.

13. An internal combustion engine, comprising:

an engine block;

a cylinder head mounted to the engine block to form at least one combustion chamber, the cylinder head defining a first intake port, a first exhaust port and a second port, the second port comprising one of an intake port and an exhaust port;

a first intake valve mounted to the cylinder head and arranged at least partially within the first intake port, the first intake valve being movable between an opened position and a closed position to selectively open and close the first intake port, respectively;

a first exhaust valve mounted to the cylinder head and arranged at least partially within the first exhaust port, the first exhaust valve being movable between an opened position and a closed position to selectively open and close the first exhaust port, respectively;

a second valve mounted to the cylinder head and arranged at least partially within the second port, the second valve being movable between an opened position and a closed position to selectively open and close the second port, respectively;

a rotating cam mechanically coupled to the first intake valve and the first exhaust valve, the rotating cam actuating the first intake valve and the first exhaust valve between the open and closed positions; and a hydraulic valve actuator coupled to the second valve to selectively actuate the second valve between the open and closed positions, wherein the hydraulic valve actuator further comprises:

an actuator housing having a piston cavity, an inlet port, a high pressure port in fluid communication with a high pressure fluid conduit, and a low pressure port in fluid communication with a low pressure fluid conduit;

a piston disposed at least partially within the piston cavity and having a first surface at a first end in fluid communication with the inlet port, the first surface and actuator housing defining a volume; and, an actuator valve disposed within the actuator housing in fluid communication with the inlet port, the high pressure port, the low pressure port and the volume through the inlet port.

14. The internal combustion engine of claim 13, wherein:

the actuator housing includes a solenoid;

the actuator valve includes a magnetic spool valve member responsive to the solenoid such that the magnetic spool valve member is positioned in one of a first position and second position when the solenoid is activated the low pressure port is in fluid communication with a first spool channel of the spool valve member, the inlet port and the volume when the spool valve member is in the first position; and the high pressure port is in fluid communication with a second spool channel of the spool valve member, the inlet port and the volume when the spool valve member is in the second position.

15. The internal combustion engine of claim 13, wherein the piston includes a first member and a second member, the second member being slideably disposed within the first member, the first surface of the piston formed at least in part by a first member surface and a second member surface.

16. The internal combustion engine of claim 15, wherein the first member has a flanged head portion at a first end of the first member, and wherein the first member surface is larger than the second member surface.

17. The internal combustion engine of claim 16, wherein the surface area of the first member surface is between about 8 to about 10 times the surface area of the second member surface.

18. The internal combustion engine of claim 16, wherein the flanged head portion has a cylindrical outer surface and the first member has a cylindrical inner surface forming a passage extending from the first end of the first member to a second end of the first member, the second member being at least partially disposed within the passage.

19. The internal combustion engine of claim 18, wherein:

the cylindrical inner surface has a first cylindrically shaped surface having a first diameter, a frustoconical portion extending between the first cylindrically shaped inner surface and a second cylindrically shaped inner surface having a second diameter larger than the first diameter, the first cylindrically shaped surface being closer to the first end than the second cylindrically shaped surface; and the second member has a first cylindrically shaped outer surface slideably engaged with the first cylindrically shaped inner surface, and a second cylindrically shaped outer surface slideably engaged with the second cylindrically shaped inner surface.

* * * * *